US006616488B1

(12) United States Patent
Tsukishima

(10) Patent No.: US 6,616,488 B1
(45) Date of Patent: Sep. 9, 2003

(54) ELECTRICAL CONNECTOR SYSTEM

(76) Inventor: Joe K. Tsukishima, 4911 Fourier Drive S.E., Calgary, Alberta (CA), T2A 0S9

( * ) Notice: Subject to any disclaimer, the term of this patent is extended or adjusted under 35 U.S.C. 154(b) by 0 days.

(21) Appl. No.: 10/053,921

(22) Filed: Jan. 24, 2002

(51) Int. Cl.[7] ..... H01R 13/02
(52) U.S. Cl. ..... 439/888; 439/692
(58) Field of Search ..... 439/879, 888, 439/692

(56) References Cited

U.S. PATENT DOCUMENTS

| | | | | |
|---|---|---|---|---|
| 3,048,810 A | | 8/1962 | Steen | |
| 3,492,639 A | | 1/1970 | Olsson | |
| 3,836,938 A | | 9/1974 | Barrett, Jr. | |
| 4,112,251 A | | 9/1978 | Scott | |
| 4,720,274 A | | 1/1988 | Tackett | |
| 4,797,509 A | | 1/1989 | Cook | |
| 5,001,301 A | | 3/1991 | Marr | |
| 5,069,634 A | | 12/1991 | Chiarolanzio | |
| 5,487,686 A | * | 1/1996 | Sawada | 439/692 |
| 6,109,984 A | * | 8/2000 | Tsou | 439/888 |

* cited by examiner

*Primary Examiner*—Gary Paumen
(74) *Attorney, Agent, or Firm*—Richard L. Mikesell

(57) ABSTRACT

An electrical connector system including first and second electrical connectors removably attached to one another. Each connector includes a first end having a plurality of apertures with internally directed side walls for securely receiving electrical wires. A second end of the first electrical connector is defined by electrically conductive rods having an enlarged and fluted end so as to be compressible. A second end of the second electrical connector includes a plurality of apertures having internally directed and electrically conductive side walls configured to accept a corresponding rod of the first electrical connector, and compress the fluted end to secure the rod therein, establishing electrical conductivity between the electrical wires.

1 Claim, 1 Drawing Sheet

FIG. 1
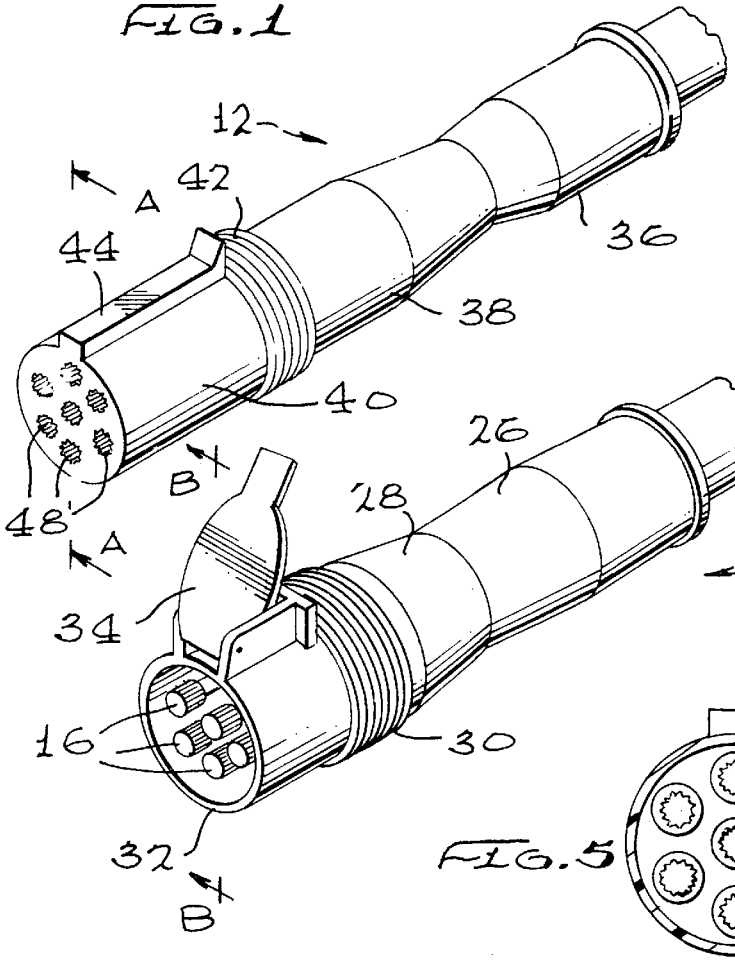
FIG. 3
FIG. 5
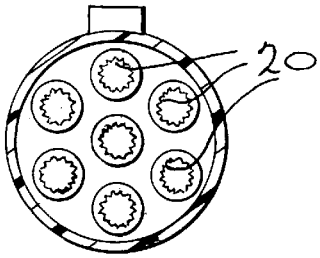
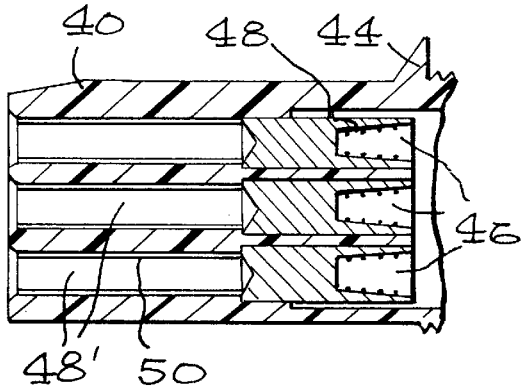
FIG. 2
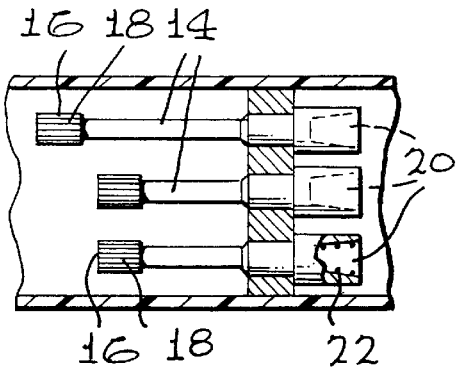
FIG. 4

ELECTRICAL CONNECTOR SYSTEM

BACKGROUND OF THE INVENTION

This invention generally relates to wire connectors. More particularly, the present invention relates to an electrical wire connector system which can be used on mobile equipment, and interconnect multiple wires simultaneously.

It is common in the electrical wiring industry to connect a plurality of wires in electrically conductive relation using wire connectors, such as twist-on cap connectors. Typically, twist-on wire connectors comprise of plastic insulating cap and a coil of wire contained therein. The cap acts as an insulating housing around the coil and also provides a means for gripping the connector in order to twist it onto the wires. The coil comes into contact with a plurality of wires being connected and retains the wires in electrically conductive relation inside the coil. While generally adequate in certain applications, there is required a twist-on wire connector for each pair of wires to be spliced to one another. Multiple wires to be connected to one another in the same circuit, yet being fed to different devices or electrical in points, require multiple twist-on caps. The space provided for making such connections may be prohibitive of such multiple twist-on caps. Also, such twist-on caps are not very esthetically pleasing. Thus, electrical junction boxes are used to house the connections.

The electrical circuitry of mobile electronic equipment often use screw connections to electrically connect wires. However, problems are created if a screw becomes loose on the mobile equipment. For example, the electrical circuitry. of the mobile equipment can be jeopardized and damaged. Correcting these problems can require a considerable amount of time and effort.

Accordingly, there is a continuing need for an electrical connector system which provides a convenient and easy manner of connecting various wires on mobile equipment, eliminating the need for screws and the problems caused by loose screw connections. What is also needed is an electrical connector system which enables the user to make multiple connections at one point that will endure heavy use. The present invention fulfills these needs and provides other related advantages.

SUMMARY OF THE INVENTION

It is an object of the present invention to provide a convenient connector that could be used to connect various wires on mobile equipment, eliminating the use of screws and the problems caused by loose screw connections.

It is another object of the present invention to eliminate the use of junction boxes and twist-on caps for multiple connections at one point.

It is another object of the present invention to provide an electrical connector system which can endure heavy use, even with mobile equipment.

In accordance with the foregoing objects of the present invention, an electrical connector system is provided comprising a first electrical connector including a first end having internally tapered side walls for securely receiving a first electrical wire therein. A second end of the first electrical connector is defined by an electrically conductive rod having an enlarged and fluted end so as to be deformable. A second electrical connector includes a first end having internally tapered side walls for securely receiving a second electrical wire therein, and a second end having internally directed an electrically conductive side walls configured to accept the rod of the first electrical connector and compress the fluted end to secure the end therein. Typically, the internally tapered side walls of the first ends of the first and second electrical connectors include an electrical wire retaining insert, in the form of a resiliently deformable internal wall.

In a particularly preferred form of the invention, the first electrical connector includes a plurality of apertures having internally directed side walls for retaining the electrical wire therein, and a plurality of electrically conductive rods extending from the second end. The second electrical connector likewise includes a plurality of apertures at the first end thereof for securing electrical wires, and a plurality of apertures which are configured to accept a corresponding rod of the first electrical connector and deform the fluted end to secure the rods therein. Typically, the second end of the first connector includes a circular housing configured to receive the second end of the second connector. In this manner, multiple electrical wires are conductively coupled to one another simultaneously in an easy manner.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view of a second electrical connector used in accordance with the present invention;

FIG. 2 is a cross-sectional view taken generally along line A—A of FIG. 1, illustrating internally tapered side walls having wire retaining inserts therein and apertures for receiving rods of a second connector;

FIG. 3 is a perspective view of a first electrical connector having electrically conductive rods extending therefrom;

FIG. 4 is a cross-sectional view taken generally along line B—B of FIG. 3, illustrating apertures having internally tapered side walls and retaining inserts therein for holding electrical wires and the rods extending opposite the apertures; and FIG. 5 is an end view of the apertures having electrical wire retaining inserts therein.

DETAILED DESCRIPTION OF THE PREFERRED EMBODIMENTS

As shown in the accompanying drawings for purposes of illustration, the present invention resides in an electrical connector system having first and second electrical connectors 10 and 12 which can be interconnected to conductively connect multiple electrical wires to one another.

With reference to FIGS. 3 and 4, the first electrical connector 10 includes a plurality of rods 14 extending from an end thereof. Each rod is comprised of a durable and conductive material, typically half hard brass. The rods 14 may vary in size and number depending upon the particular application. Each rod 14 has an enlarged end 16 having slots 18 or the like to flute the end to permit it to be deformed.

Opposite the enlarged and fluted end 16, each rod 14 is conductively connected to an aperture 20 which includes internally tapered side walls for securely receiving electrical wires therein. Preferably, each aperture 20 also includes a wire retaining insert 22. Such wire retaining inserts 22 can include a resiliently deformable internal wall, tapered coil spring, or twist connector sold under the trade name Marrette.

The electrical wires (not shown) are fed through a jacketed cable 24 and into a rubber boot 26 which can be sealed over the jacketed cable 24 so that as the individual wires extend into the body 28 of the second electrical connector 10, and into each aperture 20, the electrical wires are not exposed to the environment. The body 28 or boot 26 may include a flexible section 30, such as rubber ribs, to allow the flexing and directional needs of the connector 10 as will be described herein.

The first connector 10 may have a circular housing 32 extending from the body beyond the rods 14 for receiving a mating end of the second connector 12. Such circular housing 32 may include a cap 34 which can be pivoted into a closed position over the housing 32 to prevent the rods 14 from being exposed to the environment, or into an open position, as illustrated, to allow the union of the first and second connectors 10 and 12 to one another.

With reference to FIGS. 1 and 2, the second electrical connector 12 similarly includes a jacketed cable 36 holding the electrical wires to be connected therein, a rubber boot 38 which extends over the cable 36 and serves to seal a body 40 of the second electrical connector 12 and cable 36 to one another to prevent environmental exposure to the electrical wires therein. The boot 38 or body 40 may include a flexible section in the form of rubber ribs 42 so that the body 40 can be directed to the desired orientation to be coupled with the first electrical connector 10. The body 40 is generally cylindrical and serves as a plug which can be inserted into the circular housing 32 of the first electrical connector 10. A catch 44 may be formed on the exterior surface of the body 40 which can serve to fasten the first and second electrical connectors 10 and 12 to one another.

The second electrical connector 12 includes a plurality of aperatures 46 having internally tapered side walls and an electrical wire insert, similar to that described above, for retaining a conductive end of the electrical wires therein. The exposed end of the second electrical connector 12 includes a plurality of apertures 48' having internally directed side walls 50 which are electrically conductive and sized to accept a corresponding rod 14 of the first electrical connector 10, and deform the fluted end 16 to secure the rod 14 therein. The internally directed conductive side walls 50 are electrically connected to the wire retaining inserts 48, so that electricity is conducted through the connectors 10 and 12.

The deformation of the enlarged fluted end 16 of each rod 14 ensures the secure, yet removable, connection between the connectors 10 and 12. The flexing ribs 30 and 42 allow the first and second connectors 10 and 12 to be directed towards one another for interconnection, even at fairly awkward angles. Once the first and second connectors 10 and 12 are interconnected with one another, environmental contaminants cannot easily enter into the conductive portions of each connector 10 and 12.

The use of multiple rods 14 and apertures 48 allow multiple wires to be connected to service other locations in the same circuit in an easy manner. This eliminates the need far junction boxes, and the use of multiple twist cap connectors. As the union between the first and second connectors 10 and 12 is secure, there is little concern of the electrical connection being broken during use of the mobile electronic equipment. Although electrical connectors 10 and 12 have been illustrated and described as having multiple rods 14 and receiving apertures 48', it should be understood by the reader that as few as a single rod 14 and aperture 48' could be used in certain circumstances.

The present invention provides multiple "take-off" capabilities with a variety of wire sizes in a confined area. The present invention also provides low voltage and low amperage solid continuity with multiple wire to individual sensors, or other electronic devices, and provides a consistent connection for low voltage, high amperage circuits on charging circuits. The present invention could also be used as a reverse pin and socket on a ground circuit with a European 24-volt electrical system. As will be appreciated by the reader, the electrical connector system of the present invention is especially useful for products that endure heavy use, such as mobile electronic equipment. As such, the invention can be adapted for industrial or automotive applications and would be simple to use.

Although several embodiments of the present invention have been described in detail for purposes of illustration, various modifications of each may be made without departing from the spirit and scope of the invention. Accordingly, the invention is not to be limited, except as by the appended claims.

What is claimed is:

1. An electrical connector system comprising:

A) a first electrical connector unit which includes (1) a housing having a first end, a second end, a longitudinal axis extending between the first end and the second end and an internal dimension adjacent to the second end, (2) a plurality of rods mounted in the housing of said first electrical connector unit, each rod of the plurality of rods including (a) a first end and a second end and a longitudinal axis extending between the first end of each rod and the second end of each rod and extending in the direction of the longitudinal axis of the housing, the rods being formed of electrically conductive material, (b) a wire retaining element electrically connected to the first end of each rod, each wire retaining element including a wire retaining aperture and wire retaining elements on the wire retaining element adjacent to the wire retaining aperture, each wire retaining element being electrically conductive, and (c) a connector element on the second end of each rod, and each connector element being formed of deformable and electrically conductive material and having an external dimension;

B) a second electrical connector unit which includes (1) a housing having a first end, a second end, a longitudinal axis extending between the first end of the housing of said second electrical connector unit and the second end of the housing of said second electrical connector unit, and an outer dimension adjacent to the second end of the housing of said second electrical connector unit which is smaller than the internal dimension of the housing of said first electrical connector unit adjacent to the second end of the housing of said first electrical connector unit, the second end of the housing of said second electrical connector unit being accommodated in the second end of the housing of said first electrical connector unit in a use configuration, (2) a plurality of apertures defined in the housing of said second electrical connector and extending from the second end of the housing of said second electrical connector unit in the direction of the longitudinal axis of the housing of said second electrical connector unit toward the first end of the housing of said second electrical connector unit, each aperture including (a) a first end located adjacent to the second end of the housing of said second electrical connecter unit and a second end spaced apart from the first end of the aperture of said second electrical connector unit in the direction of the longitudinal axis of the housing of said second electrical connector unit toward the first end of the housing of said second electrical connector unit, (b) an electrically conductive sleeve in each aperture of said second electrical connector unit, each sleeve having an internal dimension which is smaller than the external dimensions of the connector elements of said first electrical connector unit, each sleeve being supported by the housing of said second electrical connector unit, a connector element of said first electrical connector unit being accommodated in and being in electrical contact with a sleeve of said second electrical connector unit in the use configuration and being deformed by such accommodation, and (c) an electrically conductive wire retaining insert element on each sleeve, each wire retaining insert element of said second electrical connector unit including a wire accommodating aperture and wire retaining elements on the wire retaining insert element adjacent to the wire accommodating aperture of each wire retaining element of said second electrical connector unit;

C) a lock unit connecting said first electrical connector unit to said second electrical connector unit in the use configuration; and D) each rod of said first electrical connector unit being electrically connected to an associated sleeve of said second electrical connector unit via the connector element on the rod in the use configuration whereby an electrical wire electrically connected to the connector element on the rod via the wire retaining element on the rod is electrically connected to a wire electrically connected to the electrically conductive wire retaining insert element connected to the associated sleeve of said second electrical connector unit in the use configuration.

* * * * *